United States Patent [19]

Schall et al.

[11] 4,121,866

[45] Oct. 24, 1978

[54] SANITARY DISPOSAL APPARATUS

[76] Inventors: Diane S. Schall; Karen A. Symmes, both of 15225 Devonshire St., Mission Hills, Calif. 91345

[21] Appl. No.: 777,625

[22] Filed: Mar. 14, 1977

Related U.S. Application Data

[63] Continuation-in-part of Ser. No. 681,162, Apr. 28, 1976, abandoned.

[51] Int. Cl.[2] ..... A01K 29/00

[52] U.S. Cl. ..... 294/19 R; 294/1 R; 294/55

[58] Field of Search ..... 294/1 R, 19 R, 19 A, 294/55; 15/257.1, 257.4, 257.7; 56/332, 400.11, 400.13; 119/1; 141/108; 209/418, 419; 248/99, 101

[56] References Cited

U.S. PATENT DOCUMENTS

| | | | |
|---|---|---|---|
| 138,541 | 5/1873 | Stiles | 294/55 |
| 397,346 | 2/1889 | Ellis | 248/99 |
| 398,330 | 2/1889 | Jacobs | 294/55 |
| 1,045,017 | 11/1912 | Gibson et al. | 294/55 |
| 3,659,891 | 5/1972 | Pettenon et al. | 294/19 R |
| 3,677,596 | 7/1972 | Yonaites et al. | 294/1 R X |
| 3,754,785 | 8/1973 | Anderson | 294/19 R |
| 3,757,737 | 9/1973 | Drum et al. | 294/55 X |
| 3,806,984 | 4/1974 | Hilsabeck | 15/257.7 |

*Primary Examiner*—Johnny D. Cherry
*Attorney, Agent, or Firm*—Jack C. Munro

[57] ABSTRACT

A device to facilitate the picking up and the disposing of animal feces comprising a handle which is connected to a ring-shaped supporting device having an enlarged aperture therein, a plastic bag to be inserted through the enlarged aperture with the mouth section of the bag being draped over the ring-shaped supporting device and the slack taken up in the bag secured to a clamping device mounted on the back side of the ring-shaped supporting device. The front end of the ring-shaped supporting device is deflected slightly so as to facilitate level, smooth contact when placed in contact with the ground.

9 Claims, 3 Drawing Figures

SANITARY DISPOSAL APPARATUS

REFERENCE TO PRIOR APPLICATIONS

This application is a continuation-in-part of patent application Ser. No. 681,162 filed Apr. 28, 1976, now abandoned, entitled Sanitary Disposal Aparatus, by the same inventors.

BACKGROUND OF THE INVENTION

The present invention relates to sanitary devices and in particular to a portable sanitary apparatus for picking up and facilitating disposal of dog litter.

In recent years, much emphasis has been placed on improving the environment in large urban areas. In many cities, an expanding dog population has created environmental health problems which have led Government Officials to place strict controls on dog owners and urge that owners clean up after their animals.

In the past, it has been a known practice for one to pick up dog litter by using a scoop or shovel which then requires that the scoop or shovel be cleaned after the dog litter is disposed of. There is a definite need for a device to pick up the dog litter without the dog feces coming into contact with the device itself and thereby eliminating the need for the device to be cleaned.

SUMMARY OF THE INVENTION

The apparatus of this invention is believed to be summarily described in the Abstract Of The Disclosure and reference is to be had thereto.

A primary objective of the structure of this invention is to construct a dog feces pick-up device which, after use, does not require that the device be cleaned because the litter has not come into contact with the device.

A further objective of the device of this invention is that it employs the use of conventional thin walled plastic bags which are readily available and are not only purchaseable, but also are frequently used in grocery stores and dry cleaners, therefore, the operator can use any type available plastic bag.

A further advantage of this invention is that it is constructed of few parts and can be manufactured at a rather inexpensive price and has no working parts, therefore, having an infinite life as long as it is used normally.

DETAILED DESCRIPTION OF THE SHOWN EMBODIMENT

Figure 1:
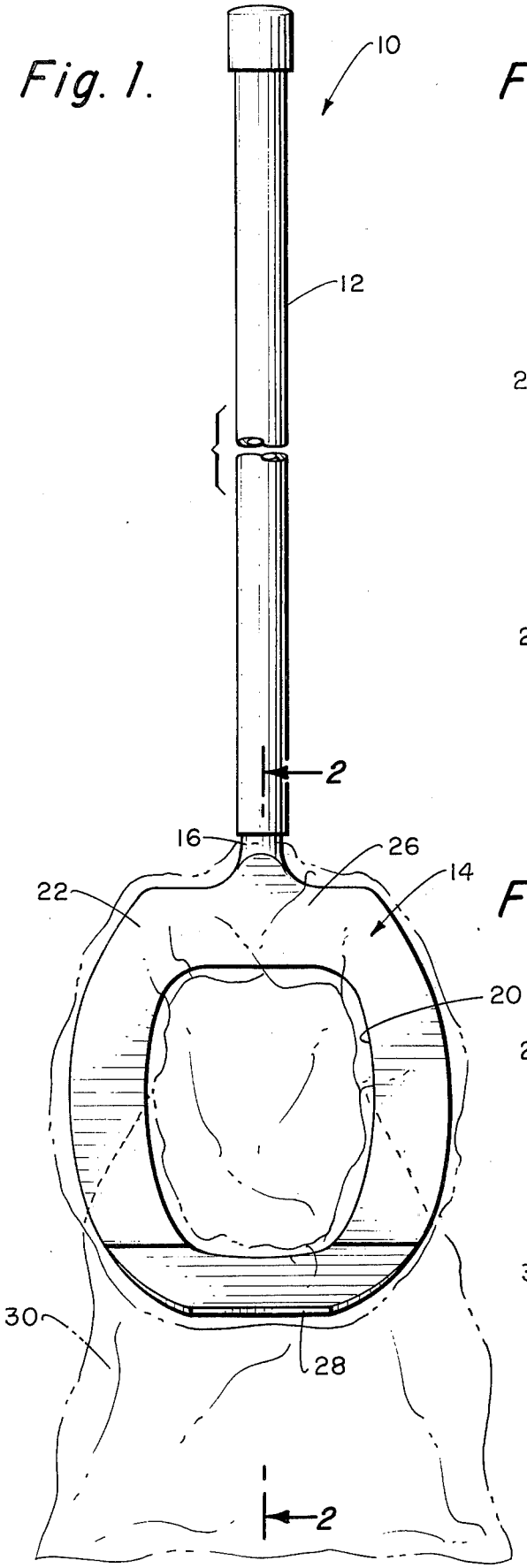
FIG. 1 is a plan view of the apparatus of this invention.

Referring particularly to the drawing, there is shown the apparatus 10 of this invention in which there is a conventional elongated cylindrical shaped handle 12 which is fixedly secured to a ring-shaped supporting device 14. The handle 12 can be fixedly secured to the device 14 by any conventional means, such as the ring-shaped supporting device having a protruding flange 16 which extends in a tight fitting manner within an interior chamber 18 of the handle 12. However, the handle 12 may be formed integral with the member 14.

The ring-shaped supporting member will normally be formed of a plastic or other type of rigid material. However, the plastic is to be somewhat flexible for a reason to be described further on in the specification.

The ring-shaped supporting device includes an enlarged central opening 20. The ring-shaped supporting device 14 is slightly oblong in configuration. The ring-shaped supporting device has a front end 22, a back end 24 and an upper end 26 which includes flange 16 and a lower end 28. The device 14 is substantially planar with the width being significantly greater than the thickness. The preferred width is one inch with the thickness being one-fourth of an inch. The lower end 28 is deflected outwardly so that when the ring-shaped supporting device is placed against the ground it will normally rest against the ground in a smooth level manner with a person holding the handle 12. With the flat back side of lower end 28 against the ground, by slightly pushing downward, the device 14 bends slightly. The forward movement then to pick up the dung results in a slight "snap" action of the device 14 which facilitates the scooping procedure.

Figure 2:
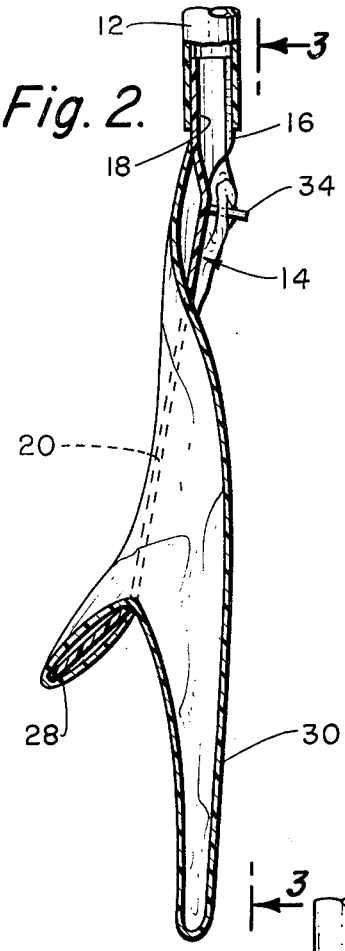
FIG. 2 is a cross-sectional view taken along line 2—2 of FIG. 1 showing the apparatus in connection with a feces receiving bag.
Figure 3:
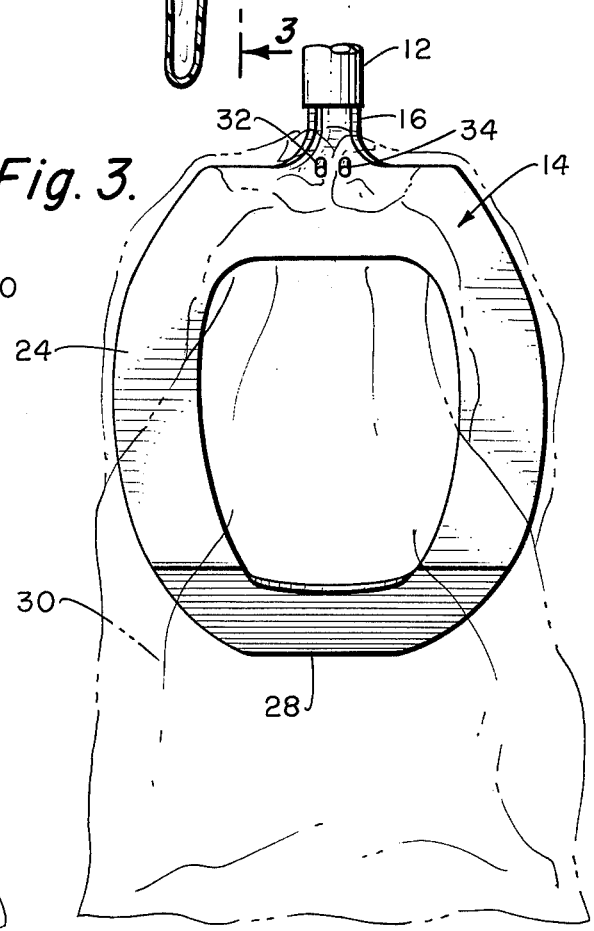
FIG. 3 is a back view of the device of this invention taken along line 3—3 of FIG. 2.

A thin-walled plastic bag 30 is to be inserted through the enlarged opening 20. The portion of the bag 30 around the mouth of the bag is to be draped across the width over the ring-shaped supporting member 14 as is clearly shown in FIG. 2 of the drawing. Because of this increased width, the bag 30 is more securely held upon the device 14 helping to eliminate accidental dislodgment. The width also provides a flat solid surface to "pick up" the dung in the scooping operation.

The slack in the bag after it is draped over is attached to a clamp in the form of posts 32 and 34 located in a closely spaced apart manner upon the back 24. The bag is tightened and the slack is twisted and then squeezed between the posts 32 and 34 thereby holding the bag in the tightened position. The clamp 32 can take any of numerous forms, other than the posts described. For example, a single clip could be used.

In operation, the bag is inserted through the enlarged opening 20 and is pulled taut and is attached between the posts 32 and 34. The device is then placed behind an animal feces and is moved forward resulting in the animal feces passing through the enlarged opening and falling within the confines of the bag 30. However, because the bag 30 is completely surrounding the ring-shaped supporting member 14, the animal feces does not come into direct contact therewith and there is no contamination of the device itself. The animal feces only comes into contact with the bag 30 and no other part of the device.

What is claimed is:

1. An apparatus to facilitate picking up and disposing of animal feces which are located on the ground comprising:

an elongated handle;

a thin ring-shaped supporting device defining an annular wall, said supporting device having an upper end and a lower end, a front side and a back side and an enlarged internal opening therein, said annular wall being substantially planar resulting in the width of said annular wall being significantly greater than the thickness, said handle being connected to said upper end of said ring-shaped supporting device;

a thin-walled plastic bag being adapted to be inserted through said enlarged opening with the portion of the bag around the mouth of the bag being draped over across said width of said annular wall and around said handle, said bag to connect with a bag securing means mounted on said back side of said annular wall directly adjacent said handle, said annular wall is then to be placed against the ground and the animal feces being scooped up to within the plastic bag, whereby the bag can be removed and disposed of without any feces having come into direct contact with said annular wall.

2. The apparatus as defined in claim 1 wherein:

said lower end of said ring-shaped supporting device being deflected outwardly resulting in said front side being slightly concave, said back side of said lower end forming a substantially flat surface so as to facilitate smooth level contact with the ground.

3. The apparatus as defined in claim 1 including:

said bag securing device being integral with said annular wall, whereby after the mouth of said bag is draped over said ring-shaped supporting device the slack is taken up in the bag and held secure by said bag securing device which results in the mouth of the bag defining an opening smaller than the periphery of said ring-shaped supporting device which inherently prevents accidental dislodgment of the bag when in use.

4. An apparatus to facilitate picking up and disposing of animal feces which are located on the ground comprising:

an elongated handle having a longitudinal center axis;

a thin ring-shaped supporting device defining an annular wall, said supporting device having an upper end and a lower end, a front side and a back side and an enlarged internal opening therein, said annular wall being substantially planar resulting in the width of said annular wall being significantly greater than the thickness, said upper end of said device laying in a first plane, said longitudinal center axis of said handle being connected to said upper end of said ring-shaped supporting device; and a thin-walled plastic bag being adapted to be inserted through said enlarged opening with a portion of the bag around the mouth of the bag being draped across said width of said annular wall and around said handle, said bag to connect with a bag securing means mounted on said back side of said annular wall directly adjacent said handle, said annular wall is then to be placed against the ground and the animal feces being scooped up to within the plastic bag, whereby the bag can be removed and disposed of without any feces having come into direct contact with said annular wall.

5. The apparatus as defined in claim 4 wherein:

said lower end of said ring-shaped supporting device being located in a second plane, said second plane being inclined with respect to said first plane in such a manner so said front side being formed concave, whereby the back side of said lower end forming a flat surface to establish level contact with the ground to facilitate picking up of the animal feces.

6. The apparatus as defined in claim 5 wherein:

said lower end of said annular wall being formed of a slightly flexible material of construction, whereby during proper use there is a slight deflection of said annular wall just prior to the picking up of the animal feces which functions to quickly move said front end of said annular wall under the animal feces to locate such within said plastic bag.

7. The apparatus as defined in claim 4 wherein:

said annular wall being formed of a slightly flexible material of construction, whereby during proper use of the device there is a slight deflection of said annular wall just prior to the picking up of the animal feces which functions to quickly move said front end of said device under the animal feces to locate such within said plastic bag.

8. The apparatus as defined in claim 7 including:

said bag securing device being integral with said back side of said annular wall, whereby after the mouth of said bag is draped over said ring-shaped supporting device the slack is taken up in the bag and held secure by said bag securing device which results in the mouth of the bag defining an opening smaller than the periphery of said ring-shaped supporting device which inherently prevents accidental dislodgment of the bag when in use.

9. The apparatus as defined in claim 4 including:

said securing device being integral with said back side of said annular wall, whereby after the mouth of said bag is draped over said ring-shaped supporting device the slack is taken up in the bag and held secure by said bag securing device which results in the mouth of the bag defining an opening smaler than the periphery of said ring-shaped supporing device which inherently prevents accidental dislodgment of the bag when in use.

* * * * *